US008974312B2

(12) United States Patent
Cho

(10) Patent No.: US 8,974,312 B2
(45) Date of Patent: Mar. 10, 2015

(54) AUTOMATIC GOLF BALL SUPPLY DEVICE

(76) Inventor: Wan Je Cho, Busan (KR)

( * ) Notice: Subject to any disclaimer, the term of this patent is extended or adjusted under 35 U.S.C. 154(b) by 28 days.

(21) Appl. No.: 13/517,026

(22) PCT Filed: Dec. 16, 2010

(86) PCT No.: PCT/KR2010/009031

§ 371 (c)(1),
(2), (4) Date: Jun. 18, 2012

(87) PCT Pub. No.: WO2011/074898

PCT Pub. Date: Jun. 23, 2011

(65) Prior Publication Data

US 2012/0295721 A1 Nov. 22, 2012

(30) Foreign Application Priority Data

Dec. 16, 2009 (KR) ..... 10-2009-0125694
Dec. 6, 2010 (KR) ..... 10-2010-0123487

(51) Int. Cl.
*A63B 69/36* (2006.01)
*A63B 57/00* (2006.01)

(52) U.S. Cl.
CPC ..... *A63B 57/0006* (2013.01)
USPC ..... 473/132; 473/134; 473/137

(58) Field of Classification Search
CPC ..... A63B 57/0006
USPC ..... 473/132–137
See application file for complete search history.

(56) References Cited

U.S. PATENT DOCUMENTS 3,003,770 A * 10/1961 Jones ..... 473/134
3,294,402 A * 12/1966 Scott ..... 473/136

(Continued)

FOREIGN PATENT DOCUMENTS

KR 10-0353165 9/2002
KR 20-0391702 8/2005
KR 20-0418251 8/2006

OTHER PUBLICATIONS

International Search Report for PCT/KR2010/009031 mailed Aug. 25, 2011.

*Primary Examiner* — Steven Wong
(74) *Attorney, Agent, or Firm* — Ladas & Parry LLP

(57) ABSTRACT

The present invention relates to an automatic golf ball supply device, being an automatic golf ball supply device which automatically supplies golf balls to a position where the golf balls will be hit with a golf club by the user, which comprises: a frame on the upper part of which is formed a golf ball withdrawal hole; an ascending and descending mount which ascends and descends by means of a motor, and on the upper surface of which is provided a tee member where a golf ball rests, and which is provided so as to ascend and descend freely in the withdrawal hole direction following a guide provided in the frame; and a golf ball conveying loader which conveys golf balls towards the tee member of the ascending and descending mount as the outer circumferential surface rotates and makes contact with the golf balls inside a golf-ball-waiting chamber in such a way as to be able to push each golf ball and to rest the same on the tee member. Consequently, there are advantages in that the height of the frame can be minimized and there are great savings on the weight, volume and installation space of the product, and in that it is possible to reduce the number of parts and hence increase productivity and economize on production costs, and to minimize loss of motive force and so maximize the force with which the golf balls are conveyed.

10 Claims, 13 Drawing Sheets

(56) References Cited

U.S. PATENT DOCUMENTS

| | | | | | |
|---|---|---|---|---|---|
| 3,423,097 | A | * | 1/1969 | Fry | 473/136 |
| 4,981,299 | A | * | 1/1991 | Petrillo | 473/136 |
| 5,052,688 | A | * | 10/1991 | Shiau | 473/135 |
| 5,348,305 | A | * | 9/1994 | Lowe | 473/133 |
| 5,390,931 | A | | 2/1995 | Chiasson | |
| 5,464,223 | A | * | 11/1995 | Dermott | 473/134 |
| 5,549,517 | A | * | 8/1996 | Ikemoto | 473/134 |
| 5,603,664 | A | * | 2/1997 | Provost | 473/134 |
| 5,766,085 | A | * | 6/1998 | Knez | 473/132 |
| 2004/0259652 | A1 | | 12/2004 | Paicos | |

* cited by examiner

AUTOMATIC GOLF BALL SUPPLY DEVICE

RELATED APPLICATIONS

This application is a 371 application of International Application No. PCT/KR2010/009031, filed Dec. 16, 2010, which in turn claims priority from Korean Patent Application Nos. 10-2010-0123487, filed Dec. 6, 2010, and 10-2009-0125694, filed Dec. 16, 2009, each of which is incorporated herein by reference in its entirety.

TECHNICAL FIELD

The present invention relates to an automatic golf ball supply device, and in particular to an automatic golf ball supply device which makes it possible to supply a plurality of golf balls in sequence at a portion where a user hits a golf ball with a golf club in a golf game practice place or the like and makes it possible to significantly lower the height of a frame and to easily perform a forced transfer of a golf ball.

BACKGROUND ART

Golf is a sport in which a game winner is generally decided by a player who finishes all the rounds with less hits attempted to insert a small, round golf ball into a targeted hole. The golf is very popular with men or women of all ages.

For enjoying a golf game, it is very important for a player to hit a golf ball in a desired direction and to land at a desired place. The players generally practice in an indoor golf game practice place in order to build up a golf play skill before starting an actual golf game in an outdoor field.

The device designed to automatically supply golf balls in a golf game practice place is an automatic golf ball supply device generally called a tee up device.

In other words, the conventional automatic golf ball supply device is designed to automatically place a golf ball, above the ground, on a tee member made from a tube-shaped elastic material by automatically receiving a golf ball from under the ground without a user manually placing one by one a golf ball atop the tee (which is like a stick planted into the ground for the purpose of ensuring that the golf ball can be placed at a certain height from the ground).

The user can keep practicing without stops as a new golf ball is automatically supplied after the user hit a golf ball supplied from the automatic golf ball supply device.

The conventional automatic golf ball supply device has a problem that the height of the frame cannot be minimized because the height of the frame generally has at least a height higher than the sum of the height of the tee member and the height of the golf ball.

A driving force transfer device such as an additional belt or a gear or something and a forced transfer device are generally being used for the purpose of transferring a golf ball to the direction of a tee member; however the number of parts increases due to the driving force transfer device such as an additional belt or a gear or something, which results in disadvantageously lowering the productivity while increasing the manufacture cost. The driving force might lose during the operation by way of the driving force transfer device, so the forced transfer force of the golf ball significantly decreases.

DISCLOSURE OF INVENTION

Accordingly, the present invention is made to resolve the above-mentioned problems. It is an object of the present invention to provide an automatic golf ball supply device which makes it possible to minimize the height of a frame in such a way that an elliptical golf ball discharge part is provided to cause a golf ball to move over a frame and then to descend onto a tee member, and a golf ball guide slope plate is provided to guide a golf ball.

It is another object of the present invention to provide an automatic golf ball supply device which makes it possible to reduce the number of parts and to maximize the productivity and to reduce the manufacture cost and to maximize the forced transfer force of the golf ball by minimizing the loss of driving force, in such a way that there is provided a golf ball transfer roller which is directly connected with a rotary shaft of a motor and which can be spatially movable depending on the size of a golf ball.

To achieve the above objects, there is provided an automatic golf ball supply device which can automatically supply a golf ball to a portion where a user hits a golf ball with a golf club, which comprises a frame which has a golf ball discharge part at its upper side; an ascending and descending part which has a tee member on the top of which a golf ball is mounted and which freely ascends and descends in the direction of the discharge part along a guide installed at the frame and which ascends and descends by means of a motor; and a golf ball transfer roller an outer surface of which rotates and comes into contact with a golf ball for the purpose of pushing a golf ball in a golf ball standby compartment and mounting atop the tee member of the ascending and descending part, so the golf ball is forcibly transferred toward the direction of the tee member.

In addition, it is preferred that the automatic golf ball supply device according to the preset invention further comprises a golf ball guide slope plate which is installed in the golf ball standby compartment for the purpose of guiding a golf ball in the golf ball standby compartment up to a portion higher than the discharge part of the frame; and a protection member which protects the golf ball positioned higher than the discharge part.

In addition, according to the present invention it is preferred that the golf ball discharge part of the frame is formed, in whole, in a cylindrical shape or polygonal shape so that part or all the portion of a golf ball can move above the frame and can mount onto the top of the tee member.

In addition, according to the present invention, it is preferred that the protection member is selected from the group consisting of an elastic protection cap, a protection cap with a lid, a protection hair, a protection cap with a protection hair and one in combination with the above elements.

In addition, according to the present invention, the golf ball transfer roller rotates and snaps a golf ball and is movable along a spacing guide for an elastic spacing movement of the rotary shaft and is connected with the movable motor fixed at a movable frame elastically fixed at the frame by means of an elastic spring.

In addition, according to the present invention, the golf ball transfer roller rotates and snaps a golf ball, the rotary shaft of which is of a rotary shaft which is non-eccentric or eccentric to the rotary shaft of the motor.

In order to achieve the above objects, there is provided an automatic golf ball supply device which can automatically supply a golf ball to a portion where a user hits a golf ball with a golf club, which comprises a frame which has a golf ball discharge part at its upper side; an ascending and descending part which has a tee member on the top of which a golf ball is mounted and which freely ascends and descends in the direction of the discharge part along a guide installed at the frame and which ascends and descends by means of a motor; a golf ball guide slope plate which is installed in the golf ball standby compartment so that the golf ball in the golf ball standby compartment can be guided to a position higher than the discharge part of the frame; a protection member which protects a golf ball higher than the discharge part; and a golf ball transfer device which guides a golf ball to a portion higher than the discharge part of the frame by pushing the golf ball in the golf balls standby compartment and forcibly transfers the golf ball toward the direction of the tee member.

ADVANTAGEOUS EFFECTS

The automatic golf ball supply device according to the present invention is advantageously characterized in that the weight, volume and installation of a product can be saved a lot in such a way to minimize the height of the frame, and it is possible to install the product of the preset invention without damaging a steel structure within the range of a conventional inter-floor thickness of a golf game practice place, and the productivity can be enhanced by reducing the number of parts, and the manufacture cost can be saved, thus minimizing the loss of driving force, thus maximizing the forced transfer force of the golf ball.

Figure 1:
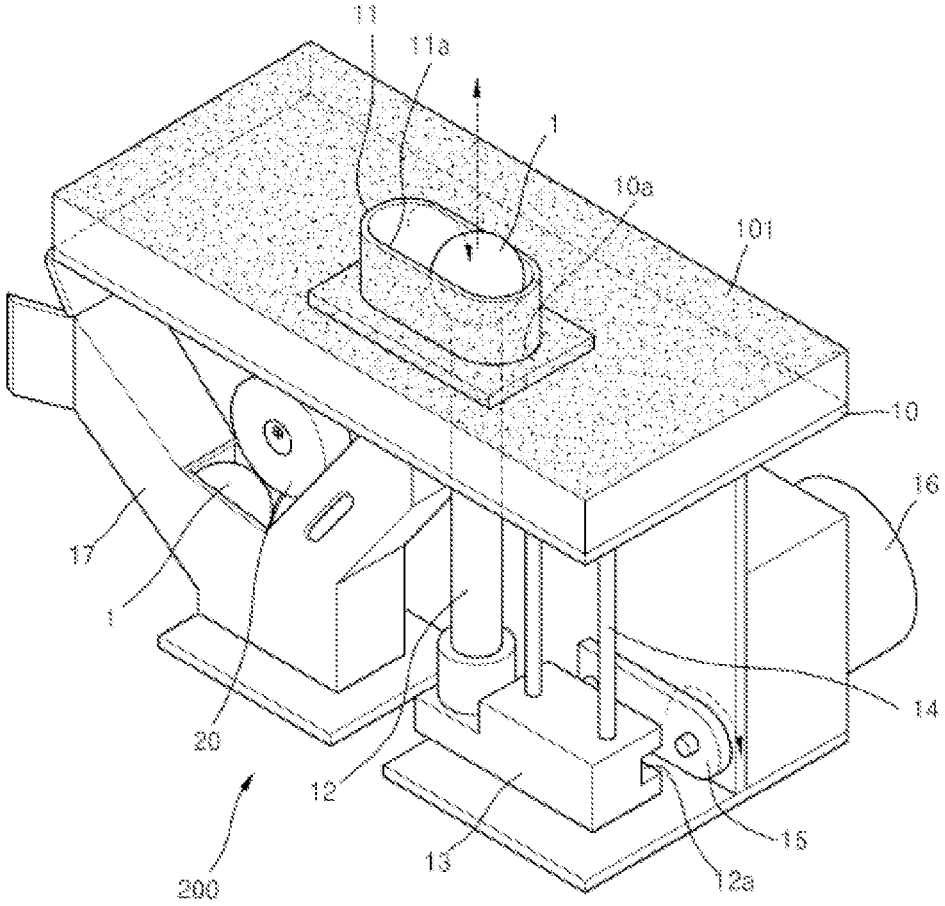
FIG. 1 is a perspective view illustrating an automatic golf ball supply device according to a preferred embodiment of the present invention.

<Descriptions of the reference numerals of the drawings>

| | |
|---|---|
| 1: golf ball | 10: frame |
| H: height | 10a: golf ball discharge part |
| 11: protection member | 11a: inner diameter surface |
| 111: lid | 31, 112: protection hair |
| 12: tee member | 13: ascending and descending part |
| 13a: side rail | 14: guide |
| 15: rotation rod | 16: motor |

-continued

<Descriptions of the reference numerals of the drawings>

| | |
|---|---|
| 17: golf ball standby compartment | |
| 17a: golf ball guide slope plate | |
| 20: golf ball transfer roller | 20a: rotary shaft |
| 21: movable motor | 22, 23: movable frames |
| 24: spacing guide | 25: elastic spring |
| 200: golf ball transfer device | 113: guide |
| 114: bent engaging piece | 115: engaging shoulder |
| 101: artificial lawn | 102: golf ball transfer tube |
| 103: steel structure | 104: concrete layer |
| T: inter-floor thickness | |

MODES FOR CARRYING OUT THE INVENTION

The automatic golf ball supply device according to embodiments of the present invention will be described with reference to the accompanying drawings.

Figure 2:
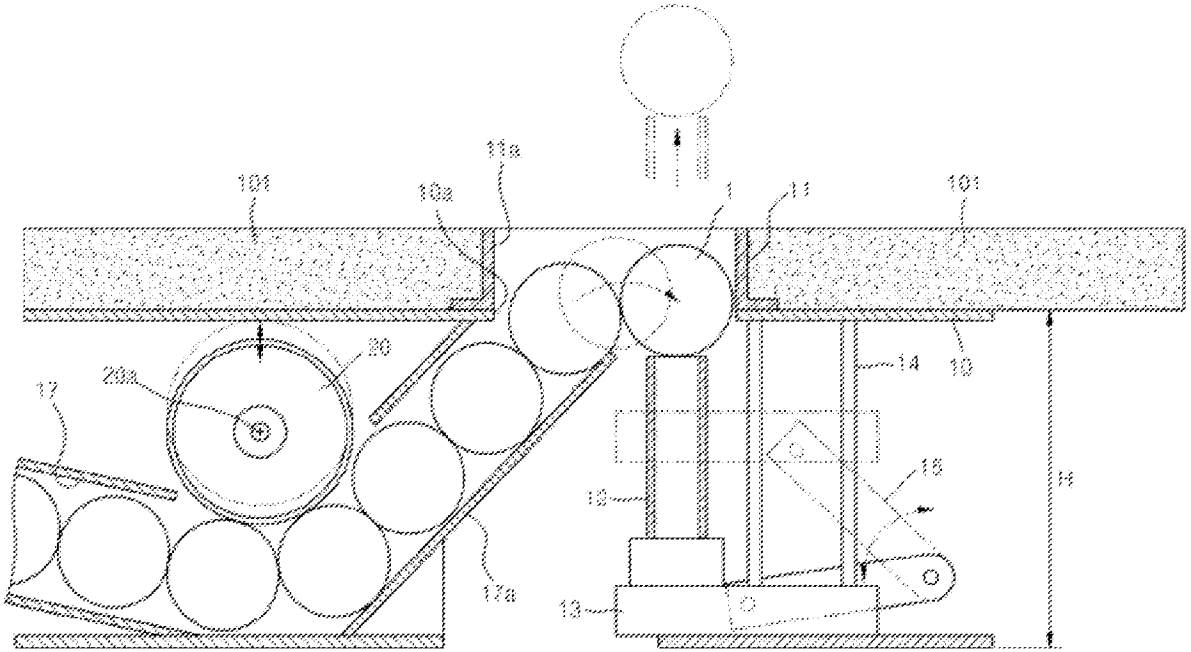
FIG. 2 is a left side cross sectional view of FIG. 1.
Figure 3:
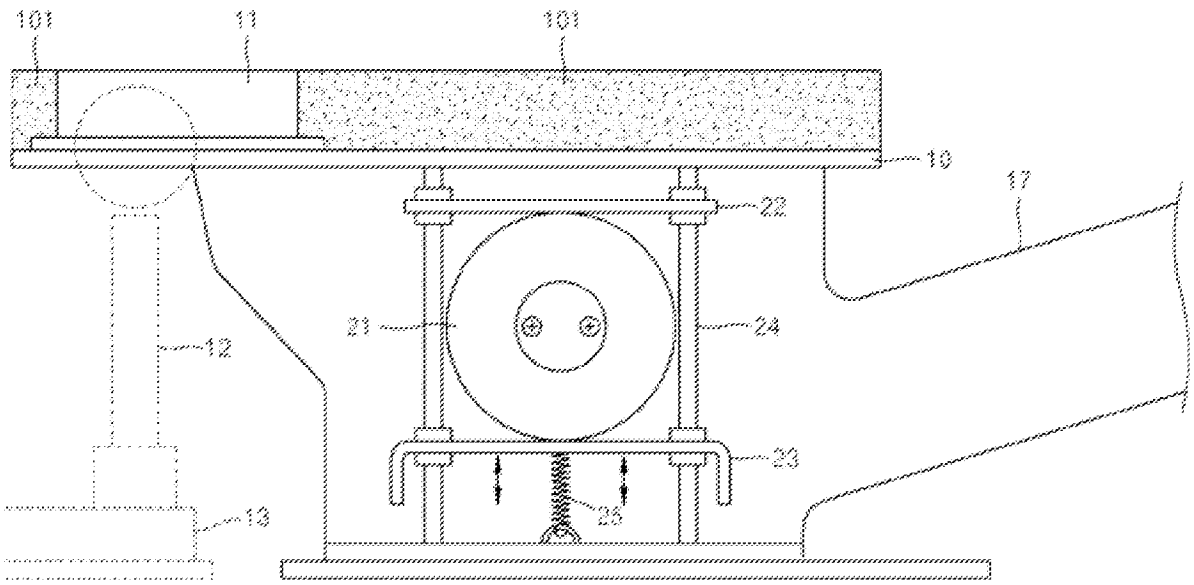
FIG. 3 is a right side cross sectional view of FIG. 1.

FIG. 1 is a perspective view illustrating an automatic golf ball supply device according to a preferred embodiment of the present invention. FIG. 2 is a left side cross sectional view of FIG. 1. FIG. 3 is a right side cross sectional view of FIG. 1.

Figure 7:
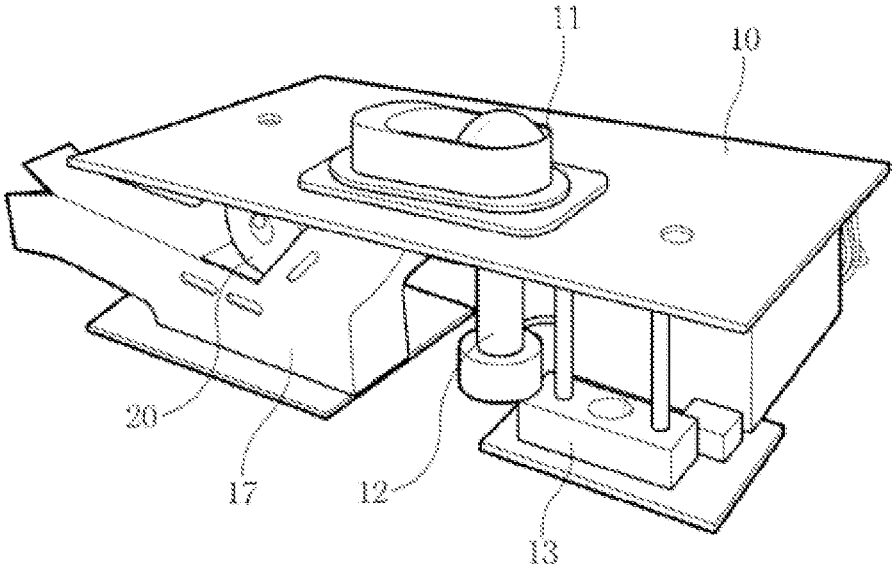
FIG. 7 is a view illustrating a front structure of an example of FIG. 1.
Figure 8:
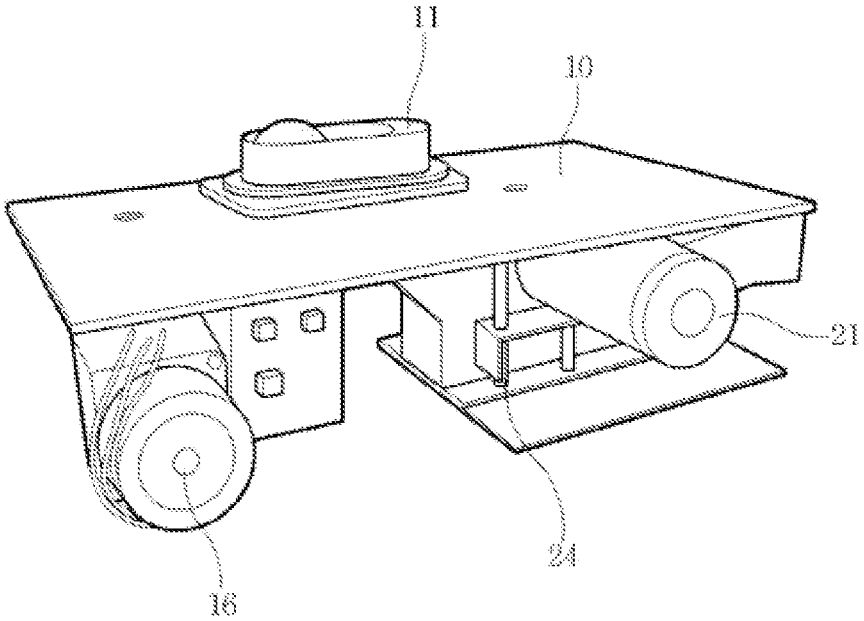
FIG. 8 is a view illustrating a rear structure of FIG. 7.
Figure 9:
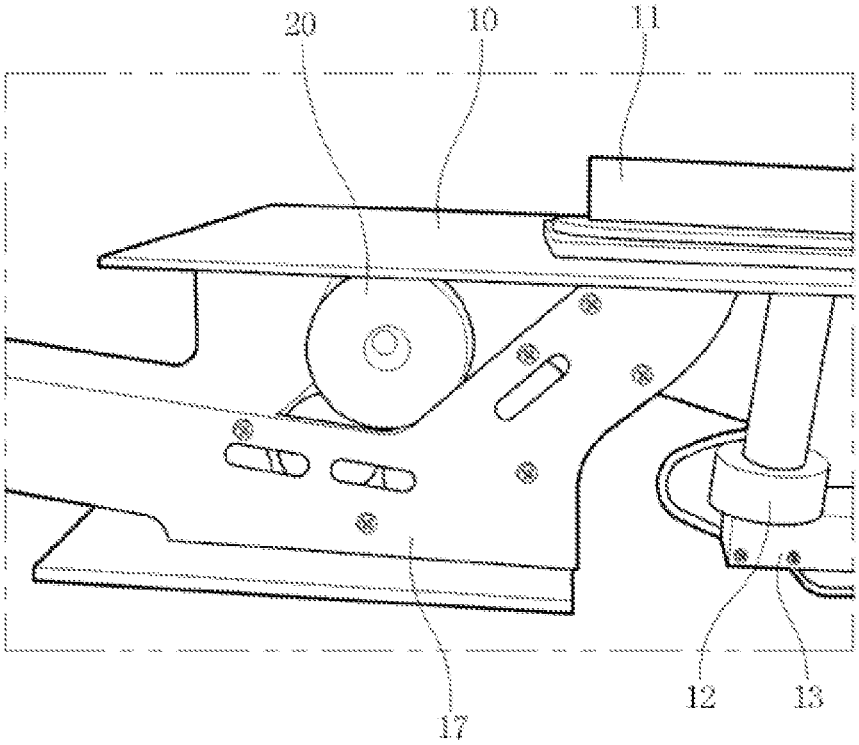
FIG. 9 is a view illustrating a golf ball transfer roller of FIG. 7.
Figure 10:
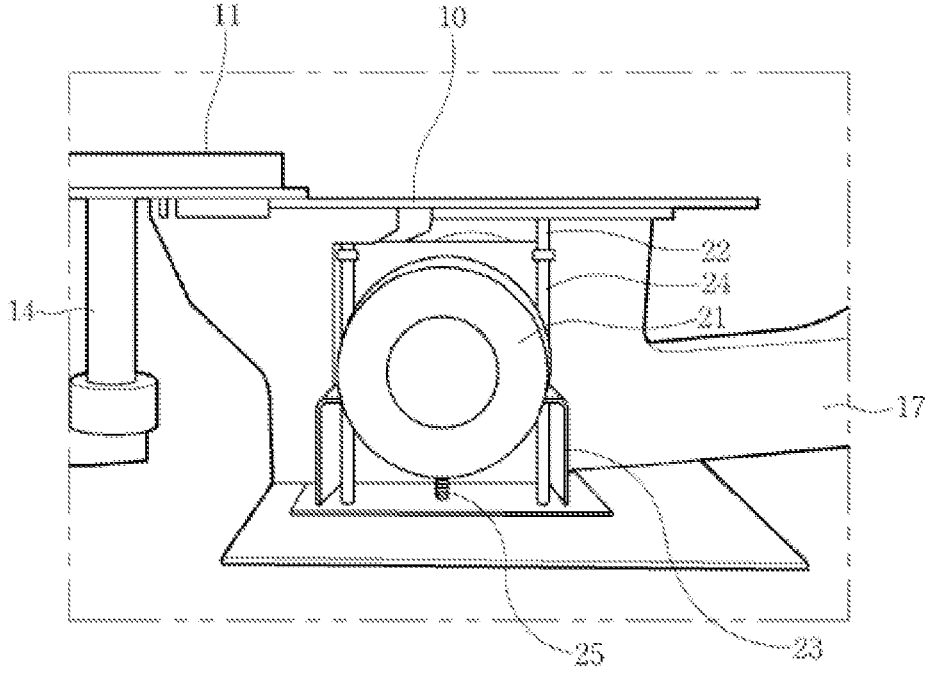
FIG. 10 is a view illustrating a rear structure of FIG. 9.
Figure 11:
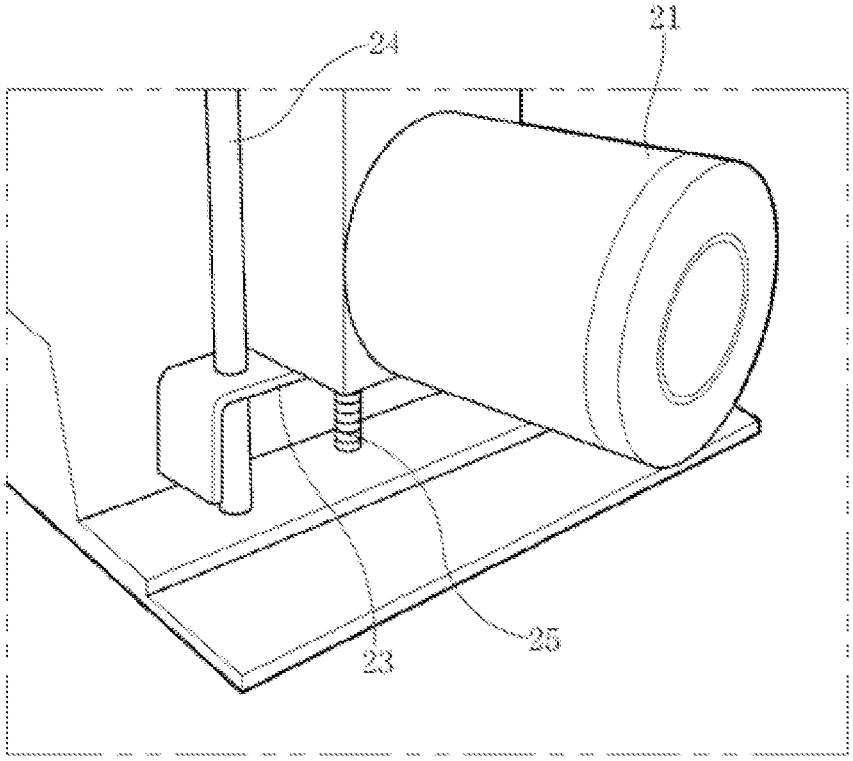
FIG. 11 is an enlarged view of FIG. 10.

FIG. 7 is a view illustrating a front structure of an example of FIG. 1. FIG. 8 is a view illustrating a rear structure of FIG. 7. FIG. 9 is a view illustrating a golf ball transfer roller of FIG. 7. FIG. 10 is a view illustrating a rear structure of FIG. 9. FIG. 11 is an enlarged view of FIG. 10.

First of all, as shown in FIGS. 1 to 3, and FIGS. 7 to 11, the automatic golf ball supply device according to a preferred embodiment of the present invention is directed to automatically supplying a golf ball 1 at a portion where a user hits the golf ball 1 with a golf club and comprises a frame 10, an ascending and descending part 13, a golf ball transfer roller 20, a golf ball guide slope plate 17*a*, and a protection member 11.

Here, the frame 10 has a golf ball discharge part 10*a* at its upper side, in particular as shown in FIG. 1, it is preferred that the golf ball discharge part 10*a* of the frame 10 is formed in a cylindrical or polygonal shape so that part or all portions of the golf ball 1 can move over the frame 10 and can be mounted atop the tee member 12.

In addition, the ascending and descending part 13 has a tee member 12 on the top of which is mounted the golf ball 1, and the ascending and descending part 13 is installed to be freely ascend and descend in the direction of the discharge part along the guide 14 installed at the frame and ascends and descends by means of the motor 16.

As shown in FIGS. 1 and 2, the ascending and descending part 13 ascends and descends by means of a rotation rod 15 one end of which rotates by means of the motor 16, and the other end of which is loosely caught by the side rail 13*a* of the ascending and descending part 13.

When the motor 16 rotates at a normal speed like the dotted line of FIG. 2, the rotation rod 15 pushes up the ascending and descending part 13, so the golf ball 1 can be supplied to at the height where the user can best hit the golf ball 1 mounted atop the tee member 12.

As shown in FIGS. 2 and 3, the golf ball transfer roller 20, which is a kind of the golf ball transfer device 200, is directed to forcibly transferring the golf ball 1 toward the direction of the tee member 12 as its outer surface rotates and comes into contact with the golf ball 1 so that the golf ball 12 in the golf ball standby compartment 17 is pushed and mounted atop the tee member 12 of the ascending and descending part 13. The golf ball transfer roller 20 is characterized in that it rotates and snaps the golf ball 1 and moves along the spacing guide 24 for the purpose of obtaining an elastic spacing movement of the rotary shaft 20*a*, and it is connected with the movable motor 21 which is fixed at the movable frames 22 and 23 elastically fixed at the frame 10 by means of the elastic spring 25.

Figure 15:
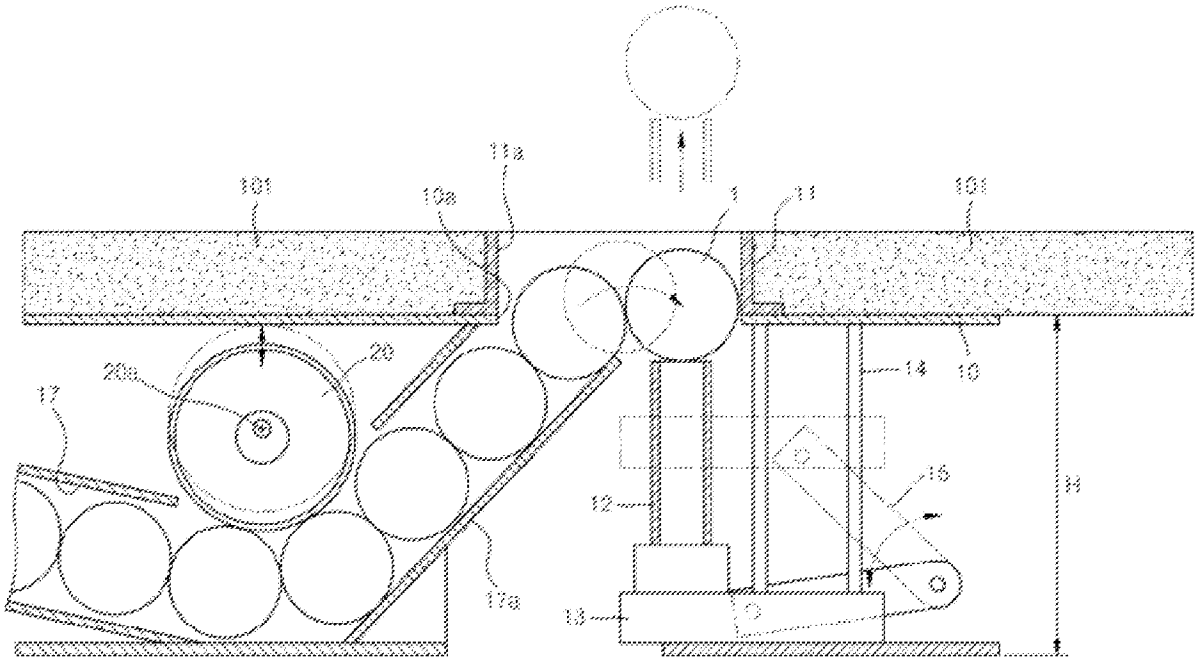
FIG. 15 is a left side cross sectional view of another example of FIG. 2.
Figure 16:
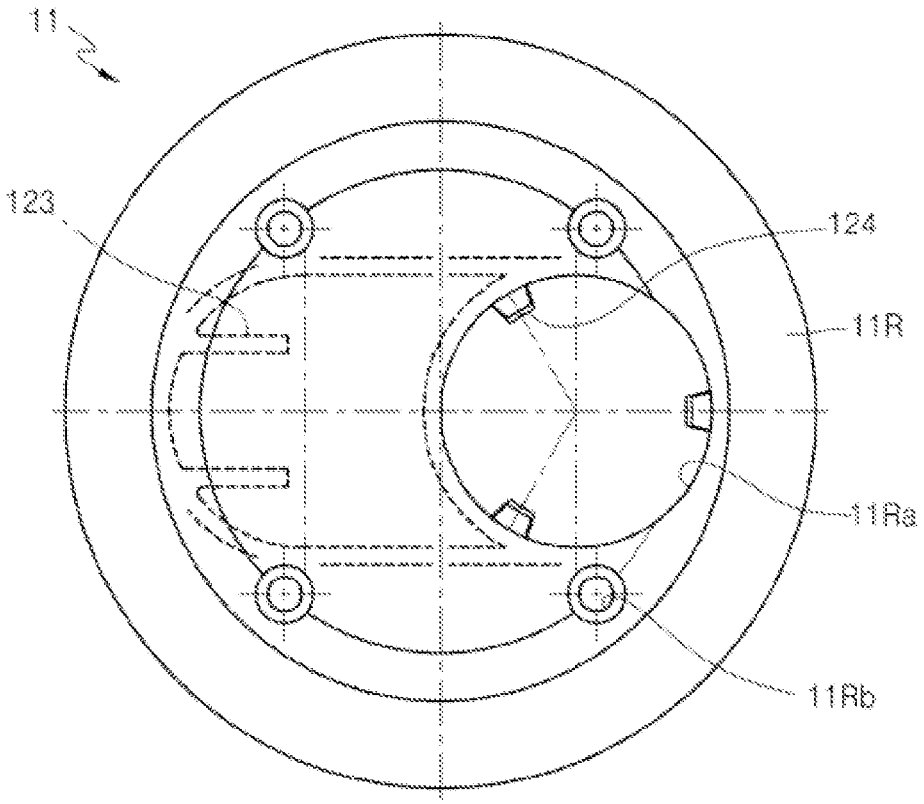
FIG. 16 is a plane view illustrating further another example of FIG. 4.
Figure 17:
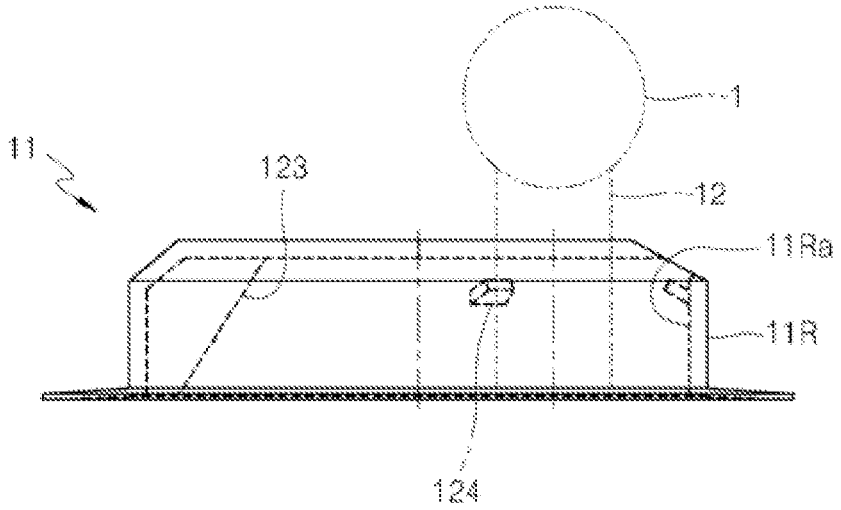
FIG. 17 is a side cross sectional of FIG. 16.
Figure 18:
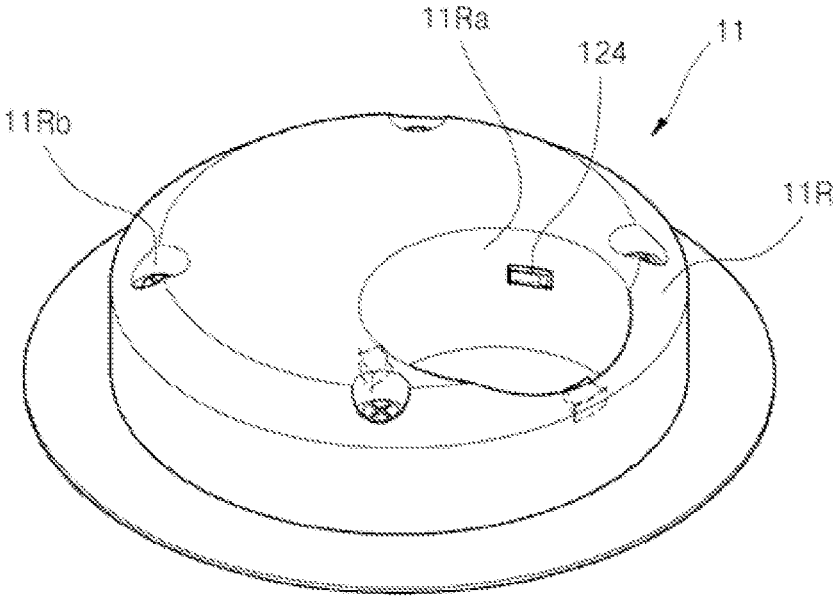
FIG. 18 is a perspective view of FIG. 16.
Figure 19:
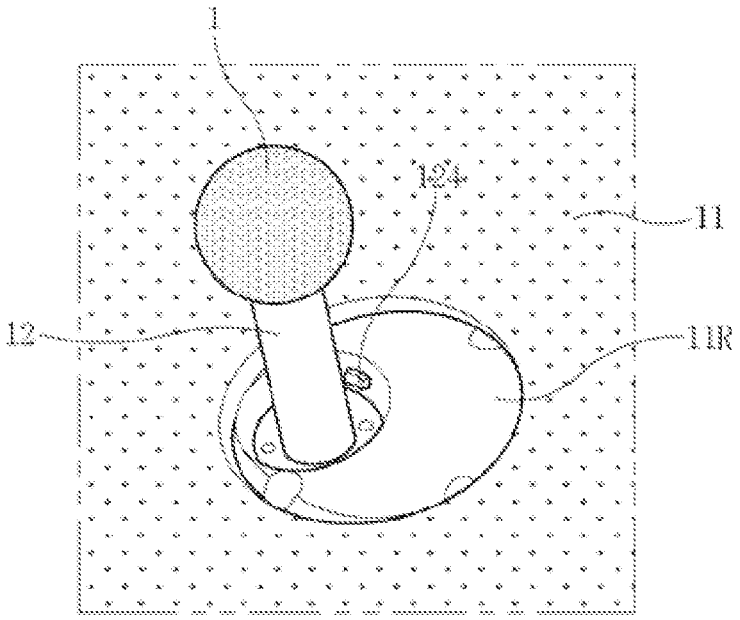
FIG. 19 is a view illustrating a use state of FIG. 16.

As shown in FIG. 2, the golf ball transfer roller 20 might be formed of a rotary shaft 20*a* which is not eccentric, and as shown in FIG. 15 it might be formed of an eccentric rotary shaft 20*a* the rotary shaft of which is eccentric to the rotary shaft of the motor 16 for the purpose of ensuring the eccentric movements of the rotary shaft while it snaps the golf ball 1 and rotates.

As shown in FIG. 2, the golf ball transfer roller 20 snaps the golf ball 1 and rotates, and relatively rides over the golf ball 1 by means of the rotary shaft 20*a*. The movable motor 21 installed at the movable frames 22 and 23 is constituted to move within a certain range elastically fixed by the elastic spring 25 in order for the above-mentioned spacing movement to be dynamically implemented.

Therefore, when the golf ball 1 is forcibly transferred, the golf ball transfer roller 20 directly connected with the movable motor 21 rotates and comes into reliable contact with the golf ball 1, so it can pushes the golf ball 1 toward the direction of the tee member 12 without using a driving force transfer device such as a complicated belt, a gear or something, thus maximizing the forced transfer force.

In addition, the golf ball guide slope plate 17*a* of the present invention is installed in the golf ball standby compartment 17 so that the golf ball 1 in the golf ball standby compartment 17 can be guided to a position higher than the discharge part 10*a* of the frame 10, as a result of which the height (H) of the frame 10 can be reduced. A substantial portion of the golf ball transferred toward and seated on the tee member upwardly protrudes from a horizontal plane of the discharge part 10*a* in a lowest descended position of the tee member.

The protection member 11 serves to protect the golf ball 1 positioned higher than the discharge part 10*a* and has an inner diameter surface 11*a* corresponding to the discharge part 10*a*.

Here, as mentioned above, it is preferred that the golf ball discharge part 10*a* of the frame 10 is formed in whole in a cylindrical shape or a polygonal shape so that part or all the portions of the golf ball 1 can move up above the frame 10 and can mount atop the tee member 12.

The golf ball supply procedure of the automatic golf ball supply device according to the present invention will be described. When the golf ball transfer roller 20 rates and comes into contact with the golf ball 1 in the golf ball standby compartment 17 and pushes the same, the golf ball 1 moves upward along the golf all guide slope plate 17*a* at the height higher than that of the frame and is pushed by the following golf ball 1 and is guided by the protection to member 11 and finally is mounted atop the tee member 12 which remains descended.

When the mounting of the golf ball 1 is detected by a golf ball detection sensor (not shown) installed at the tee member 12, the motor 16 rotates in the normal direction as indicated by the dotted line of FIG. 2, and the rotation rod 15 pushes upward the ascending and descending part 13, thus supplying the golf ball at the height where the user can best hit the golf ball 1 mounted atop the tee member 12.

Here, in the present invention, there is further provided a control part (not shown) which is characterized in that in the event that the golf ball 1 is forcibly transferred toward the tee member 12, a normal rotation signal is applied to the motor 21 rotating the golf ball transfer roller 20, and when the golf ball 1 is mounted atop the tee member 12, a reverse rotation signal is applied to the motor 21 so that the remaining standby golf balls 1 do not interfere with the users tee shot, whereby it is possible to prevent the golf ball 1 from exposing to the outside of the protection member 11.

Figure 4:
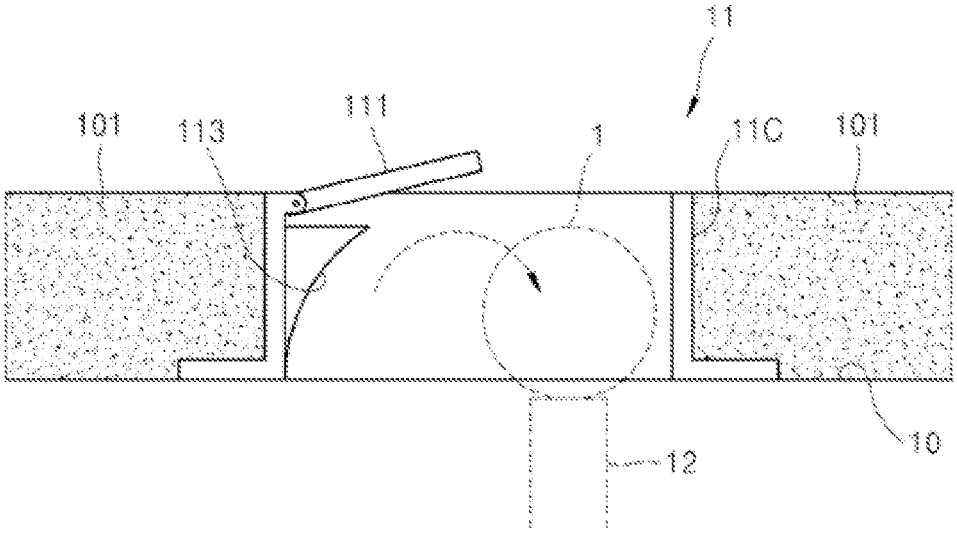
FIG. 4 is a side cross sectional view of another example of a protection member of FIG. 1.

It is preferred that the protection member 11 is made of an elastic material such as rubber, silicon, a resin material or something. As shown in FIG. 4, a protection cap 110 can be adapted, which is supported by the guide 113 and has a lid 111 protecting the golf ball 1.

Here, the guide 113 serves to support the lid 111 as well as serves to guide the golf ball 1 toward the direction of the tee member 12.

Figure 5:
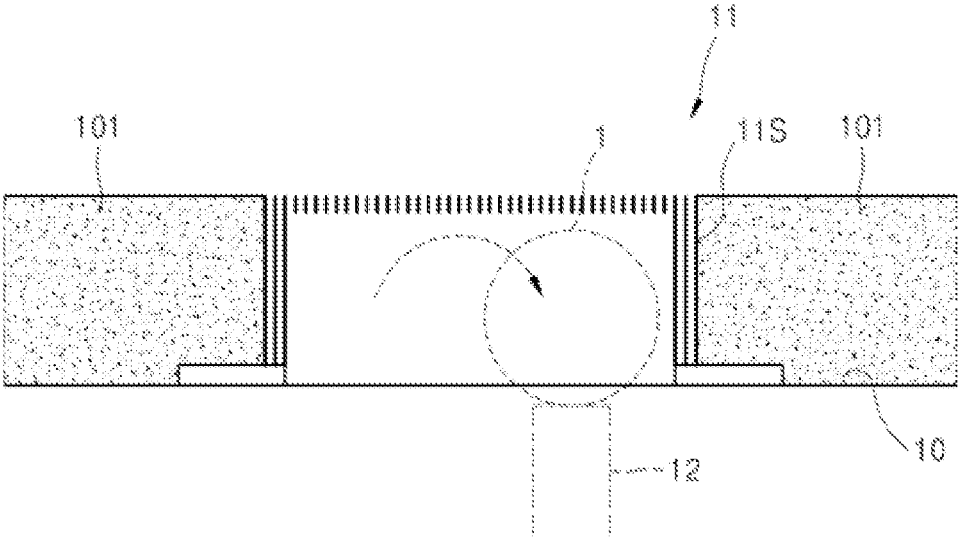
FIG. 5 is a side cross sectional view of further another example of FIG. 4.

In addition, as shown in FIG. 5, the protection member 11 might be formed of a protection hair 11S which is formed of various hairs such as artificial lawn or something.

Figure 12:
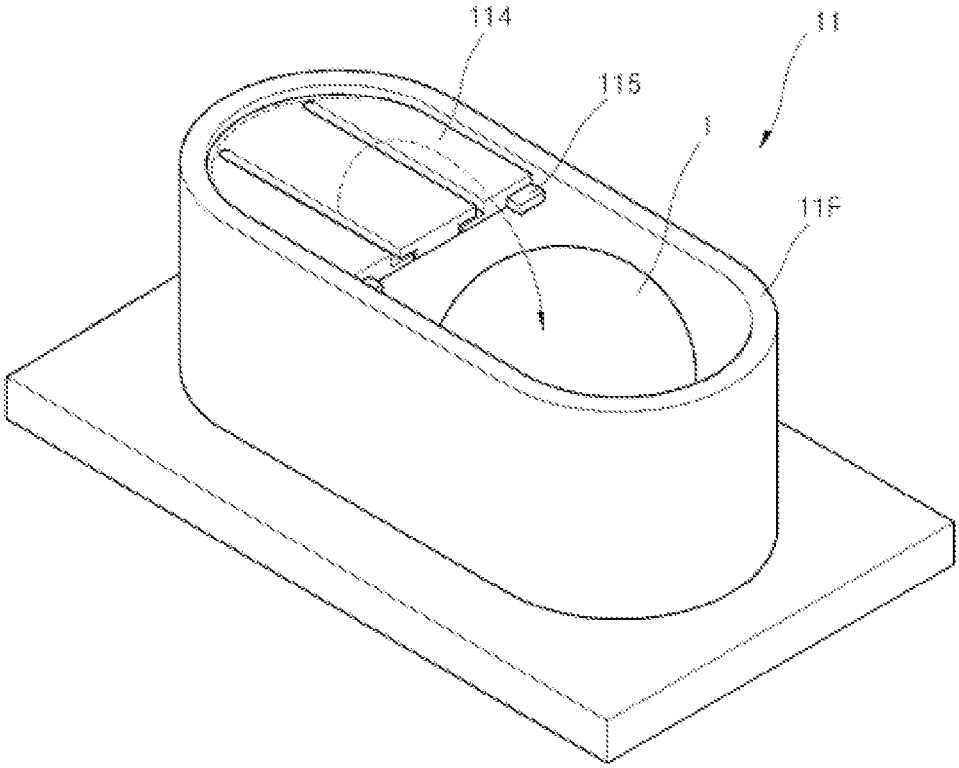
FIG. 12 is a perspective view illustrating another example of FIG. 4.

As shown in FIG. 12, there might be provided a protection cap 11F having a plurality of bent engaging pieces 114 which are caught and supported by the engaging shoulder 115.

Figure 14:
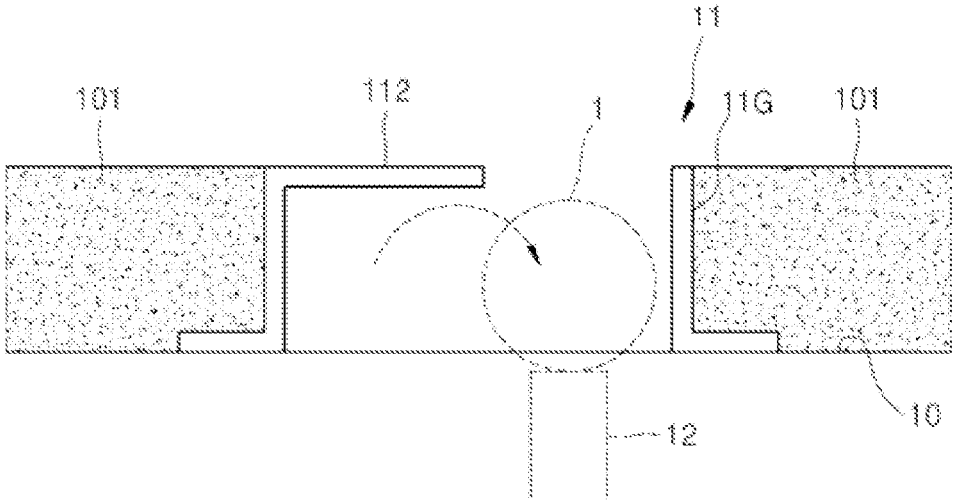
FIG. 14 is a side cross sectional view illustrating further another example of FIG. 4.

As shown in FIG. 14, there might be provided a protection cap 11G which is integral with the lid 112.

At each engaging piece 114 of FIG. 12 is formed an engaging surface 115 at its side surface, thus maintaining its shape. It is preferably made of an elastic material such as rubber, resin, silicon or something, so it can be bent by the golf ball 1 if necessary.

Figure 6:
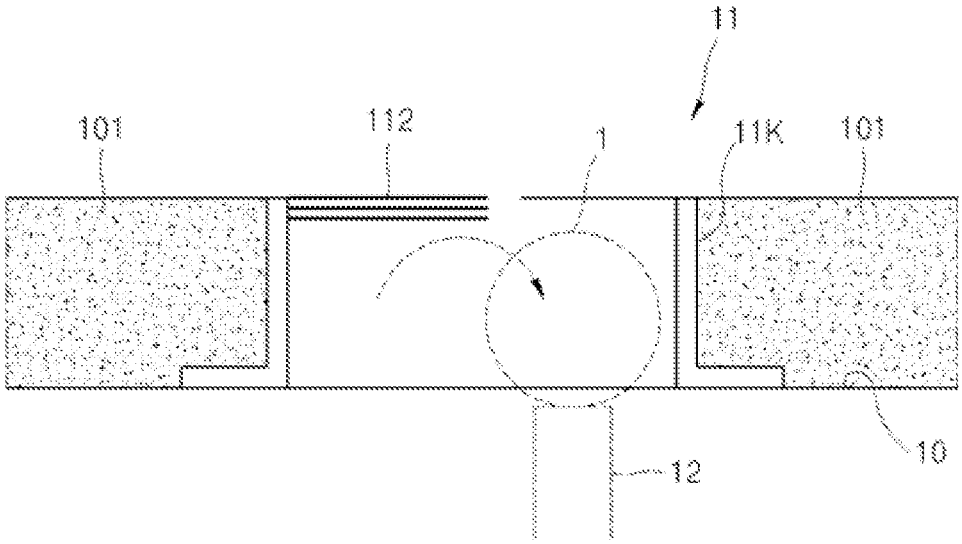
FIG. 6 is a side cross sectional view of still further another example of FIG. 4.

As shown in FIG. 6, it can be changed or modified in various forms without escaping from the scope of the technical concept of the present invention, for example, there might be provided a protection cap 11K having a protection hair 112 arranged in a horizontal direction.

As shown in FIGS. 16 to 19, as the protection member 11 of the present invention, a protection cap 11R formed, in whole, in a cylindrical shape might be adapted.

The protection cap 11R has an inner diameter surface 11*a* corresponding to the discharge part 10*a*. At the inner diameter surface 11*a* is installed a golf ball input prevention protrusion 124 for preventing an error operation which might occur as the golf ball 1 is externally inputted into the is interior of the frame 10 via the inner diameter surface 11*a*.

The golf ball input prevention protrusion 124 is made of an elastic material soft enough to easily bend when the golf ball 1 is discharged via the inner diameter surface 11*a* and not to easily bend when the golf ball 1 is externally inputted into the interior, and the golf ball input prevention protrusion 124 is protruded with an upward slope.

In addition, in the interior of the protection cap 11R might be installed a guide 123 which guides the golf ball 1 in the direction of the tee member 12.

At the protection cap 11R is formed a thread hole 11Rb in such a way to be detachable from the frame 10 by means of a fixture such as a screw, a bolt or something, the construction of which makes it possible to freely exchange the worn or damaged protection cap 11R.

As shown in FIG. 1, the automatic golf ball supply device which can automatically supply a golf ball 1 to a portion where a user hits a golf ball 1 with a golf club according to another embodiment of the present invention comprises a frame 10 which has a golf ball discharge part 10*a* at its upper side; an ascending and descending part 13 which has a tee member 12 on the top of which a golf ball 1 is mounted and which freely ascends and descends in the direction of the discharge part 10*a* along a guide 14 installed at the frame 10 and which ascends and descends by means of a motor 16; a golf ball guide slope plate 17*a* which is installed in the golf ball standby compartment 17 so that the golf ball 1 in the golf ball standby compartment 17 can be guided to a position higher than the discharge part 10*a* of the frame 10; a protection member 11 which protects a golf ball 1 higher than the discharge part 10*a*; and a golf ball transfer device 200 which guides a golf ball 1 to a portion higher than the discharge part 10*a* of the frame 10 by pushing the golf ball 1 in the golf balls standby compartment 17 and forcibly transfers the golf ball 1 toward the direction of the tee member 12.

The golf ball transfer device 200 might be formed of various types of golf ball transfer devices except for the golf ball transfer roller 20 as shown in FIG. 1.

Figure 13:
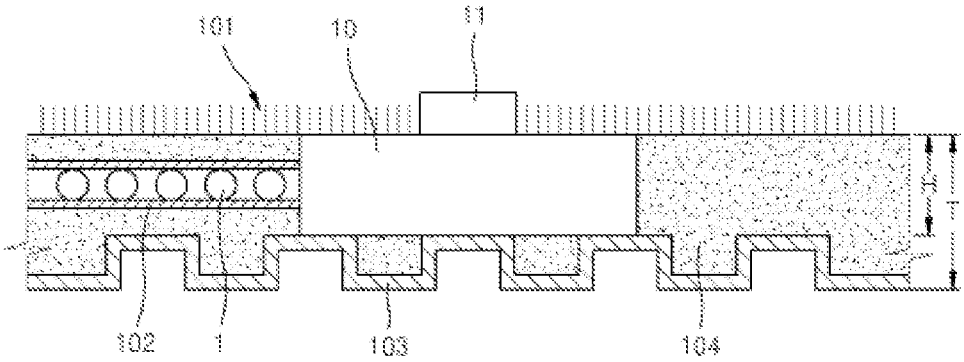
FIG. 13 is a cross sectional view of an example that an automatic golf ball supply device according to the present invention is installed in a golf game practice place.

According to the automatic golf ball supply device according to the present invention, as shown in FIG. 13, it can be substantially installed along with the concrete layer 104 on the steel structure 103 without damaging the steel structure 103 within the existing inter-floor thickness (T) in the golf game practice place with the artificial lawn 101 installed therein, by minimizing the height (H) of the frame to the height of the golf ball, namely, to 120 mm. In the conventional art, since the height (H) of the frame is above 120 mm, so the device should be installed by inevitably forming a hole at the steel structure 103. The present invention is directed to resolving all the problems encountered in the conventional art such as rain water leakage via the holes, a bad looking at the downstairs, and the weak inter-floor strengths.

The present invention is not limited to the above-described embodiments, and it is obvious that an ordinary person skilled in the art can modify within the scope without damaging the ideas of the present invention.

The scope claiming the rights of the present invention is not determined within the scopes of the detailed descriptions of the present invention, but is restricted by the following claims and the technical concepts of the same.

The invention claimed is:

1. An automatic golf ball supply device, comprising:

a frame comprising upper and lower frames;

a ball discharge hole formed at the upper frame, the ball discharge hole comprising a tee member operating area and a golf ball standby area;

a tee member installed at an ascending and descending unit, wherein the tee member is movable between a first position and a second position via the tee member operating area by the ascending and descending unit; and a golf ball guide slope plate installed in a golf ball standby compartment so that a golf ball in the golf ball standby compartment is guided to the golf ball standby area, wherein the golf ball is forcibly transferred from the golf ball standby compartment to a top of the tee member, wherein the golf ball seated on the top of the tee member is in the tee member operating area, at least a part of the golf ball being positioned substantially higher than a horizontal plane of the ball discharge hole, the horizontal plane being flush with bottom surface of the upper frame, wherein a protection member protects the golf ball positioned at the golf ball standby area while exposing the golf ball positioned at the tee member operating area.

2. An automatic golf ball supply device, comprising:

a frame comprising upper and lower frames;

a ball discharge hole formed at the upper frame;

an ascending and descending unit configured to ascend or descend toward or from the hole;

a tee member installed at the ascending and descending unit;

a golf ball transfer unit to forcibly transfer a golf ball toward the tee member, wherein the golf ball transfer unit enables a state so that a substantial portion of the golf ball transferred toward and seated on the tee member upwardly protrudes from a first horizontal plane of the hole in a lowest descended position of the tee member, wherein the first plane is flush with the bottom surface of the upper frame; and a vertical member formed at the upper frame at a circumference of the hole so as to protect the transferred ball into the hole, wherein the vertical member is formed of an elastic protection cap with a lid, a protection cap with a protection hair, protection cap with a plurality of bent engaging pieces, a lid-integrated protection cap, a cylindrical protection cap or a combination thereof.

3. An automatic golf ball supply device, comprising:

a frame comprising upper and lower frames;

a ball discharge hole formed at the upper frame;

an ascending and descending unit configured to ascend or descend toward or from the hole;

a tee member installed at the ascending and descending unit; and a golf ball transfer unit to forcibly transfer a golf ball toward the tee member, wherein the golf ball transfer unit enables a state so that a substantial portion of the golf ball transferred toward and seated on the tee member upwardly protrudes from a first horizontal plane of the hole in a lowest descended position of the tee member, wherein the first plane is flush with the bottom surface of the upper frame, wherein the transfer unit comprises a transfer roller to rotate via a motor in a contact manner with the golf ball to push the golf ball toward the tee member.

4. The automatic golf ball supply device according to claim 3, wherein the transfer roller rotates with contacting the golf ball, a rotary shaft of which is non-eccentric or eccentric to rotary shaft of the motor.

5. The automatic golf ball supply device according to claim 3, further comprising:

a control part configured such that when the golf ball is forcibly transferred toward the tee member, a forward rotation signal is applied to the motor, and when the golf ball is mounted at the top of the tee member, a reverse rotation signal is applied to the motor.

6. The automatic golf ball supply device according to claim 1, wherein a diameter of the ball discharge hole is two times larger than a diameter of the golf ball.

7. The automatic golf ball supply device according to claim 1, wherein the tee member operating area is located contiguous to the golf ball standby area.

8. The automatic golf ball supply device according to claim 1, wherein a transfer roller installed at the golf ball standby compartment is configured to rotate via a motor in a contact manner with the golf ball to push the golf ball toward the tee member.

9. The automatic golf ball supply device according to claim 1, wherein at least a part of the golf ball being guided to the golf ball standby area is positioned substantially higher than the horizontal plane of the ball discharge hole.

10. The automatic golf ball supply device of claim 1, further comprising a golf ball transfer unit to forcibly transfer the golf ball toward the tee member.

* * * * *